United States Patent [19]

Careborg

[11] Patent Number: 4,640,282

[45] Date of Patent: Feb. 3, 1987

[54] BABY PACIFIER

[75] Inventor: Bengt R. Careborg, Vetlanda, Sweden

[73] Assignee: Mo och Domsjo Aktiebolag, Ornskoldsvik, Sweden

[21] Appl. No.: 706,547

[22] Filed: Feb. 28, 1985

[30] Foreign Application Priority Data

Mar. 2, 1984 [SE] Sweden ..... 8401160

[51] Int. Cl.[4] ..... A61J 17/00

[52] U.S. Cl. ..... 128/360

[58] Field of Search ..... 128/360, 359, 252

[56] References Cited

U.S. PATENT DOCUMENTS

| | | | |
|---|---|---|---|
| 4,324,249 | 4/1982 | Sundkvist | 128/360 |
| 4,481,949 | 11/1984 | Frodrich | 128/360 |

FOREIGN PATENT DOCUMENTS

| | | | |
|---|---|---|---|
| 2656819 | 7/1977 | Fed. Rep. of Germany | 128/360 |
| 3232101 | 9/1983 | Fed. Rep. of Germany | 128/360 |
| 8686 | of 1914 | United Kingdom | 128/360 |
| 536196 | 5/1941 | United Kingdom | 128/360 |

*Primary Examiner*—Jay N. Eskovitz

[57] ABSTRACT

A baby pacifier is provided having a resilient nipple for the baby to grasp in its mouth; and having an open end with a bead extending about is outer periphery adjacent to the open end; and a circular box-shaped shield for supporting the nipple; the shield being substantially elliptical in cross-section, smooth-surfaced, and free from external projections, and having a diameter of at least 45 mm and a breadth of at least 20 mm, being formed in two shield parts held together; each shield part having a peripheral edge engaging the peripheral edge of the other shield part in a snap lock.

3 Claims, 4 Drawing Figures

BABY PACIFIER

Baby pacifiers have a nipple which is resilient and which is designed to be grasp in the mouth of the baby. The nipple is open at one end, and has a bead adjacent the open end with a circular shield or guard disc attached to the nipple in the vicinity of the bead, the bead itself preventing withdrawal of the nipple from the shield. Various types of locking elements have been used fitting within the open end of the nipple, to lock it to the shield. The shield also carries some kind of a grip, such as a ring or handle, which frequently serves as a way of locking the components of the device together. Sometimes the components are held together in a press fit, while in other cases, particularly where the components are made of plastic, they are bonded together by high frequency welding or heat-sealing.

The available pacifiers generally have a shield varying in diameter from 36 to 42 mm, with a breadth of about 1 to about 5 mm. The broadest shields have a convex shape, so that the breadth at the edge is from 0.5 to 2 mm, which means that the edge is relatively sharp.

In many cases, babies using these pacifiers manage to get the shield into the mouth as well as the nipple, or else the baby can grasp the wrong side of the device and suck on the grip. If the shield is taken into the mouth, there is a danger of choking, since the child then tries to swallow the device.

In order to prevent the child from taking the shield into the mouth, the shield has gradually been increased in size to a minimum of about 42 mm. However, a shield that is too large can be lodged against the nose, and interfere with breathing. Thus, in some cases the shields have been provided with apertures to facilitate the passage of air and the breathing of the baby, should the pacifier be taken into the mouth.

In accordance with the present invention, a baby pacifier is provided in which the shield is made in the shape of a box, which is circular and at least 42 mm in diameter, and which has a breadth of at least 20 mm, thus effectively making it impossible for the baby to take the pacifier inside the mouth. At the same time, the components including the nipple are so securely attached together that they cannot be separated, while at the same time of a simple construction that is readily and easily assembled.

The baby pacifier in accordance with the invention comprises:

(1) a resilient nipple for the baby to grasp in its mouth; and having an open end with a bead extending about its outer periphery adjacent to the open end;

(2) a circular box-shaped shield for supporting the nipple;

(3) the shield being substantially elliptical in cross-section, and having a diameter of at least 45 mm and a breadth of at least 20 mm, being formed in two shield parts held together; each shield part having a peripheral edge engaging the peripheral edge of the other shield part in a snap lock;

(4) one shield part having an aperture receiving the open end of the nipple and having an aperture wall extending over the bead and thus retaining the nipple to the shield part; the shield part also having an inwardly projecting cylindrical wall beside the aperture and abutting the bead;

(5) the other shield part having an inwardly-extending projection sized to fit within the cylindrical wall and the open end of the nipple, and long enough to fix the bead of the nipple in a position defined by the cylindrical wall when the shield parts are locked together.

The inwardly-extending projection on the other shield part is provided with shoulders or otherwise so shaped as to engage the outer end portion of the bead. The shoulders can desirably have the form of wings extending radially outwardly from the projection. This prevents inward displacement of the nipple.

The pacifier design of the invention is particularly adapted for manufacture and assembly by mass production techniques. This makes it possible to manufacture the device without touching any part of it by human hands, and thus maintain all components pharmaceutically sterile. Thus, for example, the parts of the shield can be fed from separate supply sources into an assembly position on an endless assembly belt, arranged to bring one part into abutment with the other, and the belt then presses the two parts together until their peripheral snap lock means become engaged. The nipple is inserted in the shield part having the nipple aperture, and thus upon snapping together of the two shield parts, the device is complete and ready for use. The conveyor belts serve as conveyors, and also as the means for pressing the two shield parts together in a snap lock.

The components are easily manufactured in plastic, and can thus be made extremely strong as well as light in weight. The weight distribution can be so adjusted that, in use, the center of gravity of the device lies close to the mouth of the baby. The pacifier is also liquid-tight and its design minimizes the extent to which dirt is collected in use. In addition, the device does not interfere with the growing-in of the baby's teeth.

The drawings show a preferred embodiment of the baby pacifier of the invention.

Figure 1:
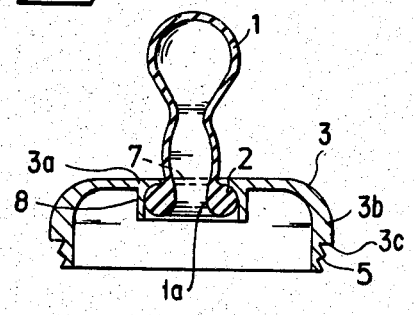
FIG. 1 shows the shield part carrying the aperture and the nipple.

The shield part 3 shown in FIG. 1 has a cup shape with a central circular aperture 7 receiving a nipple 1. The nipple has an outer peripheral bead 2 extending about the open end 1*a*. The aperture wall extends inwardly at the aperture, forming a projection 3*a*, engaging the bead 2 at the point where it merges with the nipple wall 1, and thus prevents the nipple from being withdrawn from the aperture. The shield part also has an inwardly extending cylindrical projection 8 engaging the side of the bead, and thus preventing sideways movement of the nipple at that end. The outer periphery of the shield part 3 is formed in a series of grooves 5 serving as a snap lock, engaging a mating set of grooves 6 on the other housing part, shown in FIG. 2, in a snap fit.

Figure 2:
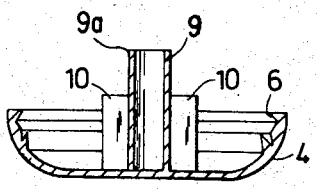
FIG. 2 shows the shield part carrying the inwardly extending projection that fits within the open end of the nipple.
Figure 3:
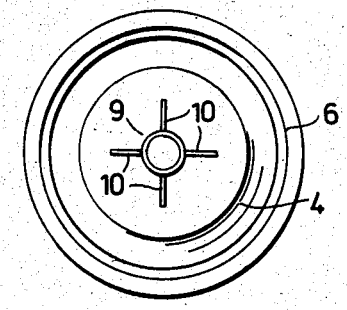
FIG. 3 is a top view of the shield part shown in FIG. 2.

The other housing part 4, shown in FIG. 2, also has a cup shape, with an inwardly extending cylindrical projection 9, that is sized to fit within the projection 8 of the first housing part, and also project into the open end 1*a* of the nipple 1. As best seen in FIG. 3, the projection 9 has four radially extending wings 10, which serve as a support for the projection 9, and also engage the outer end of the bead 2 when the two housing parts are locked together, preventing inward displacement of the nipple 1 in the finished pacifier.

The length of the projection 9 is so adjusted that when the two shield parts are locked together, the upper end 9*a* of the projection is on a level with the outer surface 3*b* of the first shield part. This prevents any resistance by the nipple 1 to a bite by the baby on the nipple adjacent the aperture 7, which would case damage to the nipple and also possibly to the baby's teeth.

The pacifier is assembled by simply bringing together the open ends of the shield parts 3 and 4, shown in FIGS. 1 and 2, so that the locking means 6 will pass over the locking means 5 on the housing part 3, and when the end of the housing part 4 abuts the shoulder 3*c* on the housing part 3, the two will be locked together permanently. The snap lock is sufficient. All the parts can be heat-sealed or spun-welded together.

Figure 4:
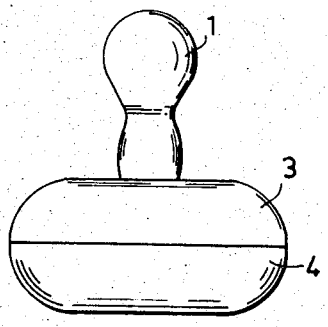
FIG. 4 is a side view of the assembled pacifier, made by snapping together the shield parts shown in FIGS. 1 and 2.

The assembled structure is seen in FIG. 4.

If desired, although not shown in the drawings, the pacifier can be provided with some form of grip, such as a ring or other handle, attached to the shield part 4, opposite the nipple 1. In this case, the center of gravity of the pacifier is shifted outwardly from the mouth of the baby, while at the same time the handle parts can increase the risk of injury to the baby, should the baby fall with the pacifier in its mouth.

The pacifier also can have apertured shields 3,4, i.e., apertures are provided in both the parts 3 and 4 to permit the passage of air through the device, from one side to the other. In this event, however, the opposite apertures in each housing part should be connected together, so that the interior of the shield is kept liquid-tight.

In order to confirm that pacifiers in accordance with the invention are particularly safe and strong, 125 pacifiers were manufactured, conforming to the design shown in FIGS. 1 to 4, and tested in accordance with Swedish standard requirements, using the National Swedish Institute for Materials Testing, KOVFS 1979:10, Section 2.3, and Section 2.5. The results of the test are set forth in Table I, which also sets out the minimum test requirements.

Because of the way in which the pacifier is constructed, a tensile strength test also was carried out between the shield and the nipple. The bite test was effected with the shield mounted in a holder, and the nipple part was loaded with a jaw at the location where the nipple joins the shield. The load was applied at an angle of about 55° to the longitudinal axis of the nipple.

TABLE I

| Treatment according to standards | Acceptance numbers | |
|---|---|---|
| | Obtained | Minimum requirement |
| Subsequent to conditioning | 13.7 | 2.0 |
| After wet treatment by boiling | 11.7 | 2.0 |
| After heat treatment and conditioning | 29.7 | 1.7 |
| After wet treatment by boiling and subsequent bite test | 6.3 | 2.0 |
| After conditioning and subsequent impact and compression tests | 14.0 | 2.0 |

It is apparent from the Table that the pacifiers in accordance with the invention more than fulfill the requirements imposed by the Swedish National Board for Consumer Policies for pacifiers.

Having regard to the foregoing disclosure, the following is claimed as the inventive and patentable embodiments thereof:

1. A baby pacifier comprising:

(1) a resilient nipple for the baby to grasp in its mouth; and having an open end with a bead extending about its outer periphery adjacent to the open end;

(2) a circular box-shaped housing constituting a shield for supporting the nipple;

(3) the shield being substantially elliptical in cross-section, and having an external surface that is smooth and continuous in extent over the entire shield, free of any projections, and having a diameter of at least 45 mm and a breadth of at least 20 mm, being formed in two housing parts held together; each housing part having a peripheral edge engaging the peripheral edge of the other housing part in a snap lock;

(4) one housing part having an aperture receiving the open end of the nipple and having an aperture wall extending over the bead and thus retaining the nipple to the housing part; the housing part also having an inwardly projecting cylindrical wall beside the aperture and abutting the bead;

(5) the other housing part having an inwardly-extending projection sized to fit within the cylindrical wall and the open end of the nipple, and long enough to fix the bead of the nipple in a position defined by the cylindrical wall when the housing parts are locked together.

2. A baby pacifier according to claim 1 in which the inwardly extending projection on the second housing part is shaped to engage the outer end portion of the bead and thus prevent inward displacement of the nipple.

3. A baby pacifier according to claim 2 in which the inwardly extending projection is provided with radially outwardly-extending wing-shaped shoulders.

* * * * *